US006518937B2

(12) United States Patent
Fang

(10) Patent No.: US 6,518,937 B2
(45) Date of Patent: Feb. 11, 2003

(54) PLANAR ANTENNA APPARATUS

(75) Inventor: Shyh-Tirng Fang, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/883,983

(22) Filed: Jun. 20, 2001

(65) Prior Publication Data

US 2002/0057227 A1 May 16, 2002

(30) Foreign Application Priority Data

Nov. 14, 2000 (TW) ..... 89124031 A

(51) Int. Cl.[7] ..... H01Q 1/38
(52) U.S. Cl. ..... 343/895; 343/700 MS
(58) Field of Search ..... 343/702, 700 MS, 343/786, 853, 806, 795, 846, 895

(56) References Cited

U.S. PATENT DOCUMENTS 4,656,482 A * 4/1987 Peng ..... 343/705
5,714,964 A * 2/1998 Jackson ..... 343/786
6,281,848 B1 * 8/2001 Nagumo et al. ..... 343/700 MS
6,292,154 B1 * 9/2001 Deguchi et al. ..... 343/806

* cited by examiner

*Primary Examiner*—Don Wong
*Assistant Examiner*—James Clinger
(74) *Attorney, Agent, or Firm*—Rabin & Berdo, P.C.

(57) ABSTRACT

A planar antenna apparatus is disclosed, which includes a monopole antenna with slits. During design, a number of slits are formed on the monopole antenna. The slits are arranged so that a path through the monopole antenna is formed, and the path has sharp turns in alternating directions. In this way, the path of the excited surface current of the monopole antenna is extended, leading to the monopole antenna operating at a lower frequency. Thus, the size of the monopole antenna is reduced as compared with the size of the conventional monopole antenna operating at the same frequency. In addition, the structure of the planar antenna apparatus can be employed for the purpose of polarization diversity. For implementation, two monopole antennas in the above structure are mounted perpendicularly. In this way, the excited surface currents of the respective antennas flow along different directions perpendicular to one another. It leads to the polarization planes and both E-plane and H-plane patterns of the two antennas are perpendicular to each other, fulfilling the purpose of polarization diversity.

18 Claims, 4 Drawing Sheets

PLANAR ANTENNA APPARATUS

This application incorporates by reference Taiwanese application Serial No. 89124031, filed on Nov. 14, 2000.

BACKGROUND OF THE INVENTION

1. Field of the Invention

The invention relates in general to a planar antenna structure, and more particularly to a planar antenna structure in which the size of a planar antenna is reduced by employing a number of slits on a monopole antenna.

2. Description of the Related Art

As the technology progresses, it makes people's daily life much easier. In terms of the communication technology, it leads to communication between people almost without the limitation of distance and time. Before, fixed domestic telephones and public telephones were the most commonly used means for communication. They are convenient to use, but they have the disadvantage of lacking mobility. Thus, immediately communicating with people would be impossible in some situations. For this reason, pagers are developed to supplement the requirements of mobile communication. As the time goes by, mobile phones are being substituted for the pagers. Users can immediately make and receive a call by mobile phones. Further, users can even connect to the Internet for browsing information, sending and receiving electronic mails through the use of wireless application protocol (WAP). With these versatile functions, mobile phones are consequently the standard for personal communication equipment. The key to the popularity of mobile phones depends on their compact sizes, innovative functions, and affordable costs. Strictly speaking, the technology of manufacturing circuits determines all of these conditions. If the technology of manufacturing circuits is mature, the relative products can be more compact. In addition, the compact products contribute to their popularity, resulting in mass production and hence lowering the production cost. In this way, how to develop more compact circuitry is an important subject that engineers and researchers greatly concern.

As discussed above, in terms of the integrated circuit development, the current and future trend is towards miniaturization. Thus, wireless communication products are invariably towards this trend. Further, in order to operate in coordination in the whole circuitry, antennas, the key components of the circuitry of wireless communication products, have to be designed to contribute to the needs of miniaturization.

Referring now to FIG. 1, it illustrates the connection of an antenna structure and high frequency circuit. The high frequency circuit 130 may be the internal circuit of a mobile phone, radio transmitter, or radio receiver. The antenna structure 100 can be regarded as the "window" of the high frequency circuit for transmitting and receiving radio signal. The antenna structure 100 includes a coupling device 110 and antenna 120, in which the coupling device 110 is used to couple the antenna structure 100 with the high frequency circuit 130. When the high frequency circuit 130 requires transmitting signal through the antenna structure 100, the signal is sent to the antenna 120 through the coupling device 110 and is then transmitted. Reversely, when the antenna 120 receives the external signal, it is sent to the high frequency circuit 130 through the coupling device 110 and then signal processing is performed. Thus, the antenna structure 100 is essential for signal transmission and receiving.

In this case, it is desired to have a more compact antenna structure and a circuitry into which the antenna structure 100 and the high frequency circuit 130 can be integrated. If it is feasible to do that, it has the advantage of reducing the complexity of manufacturing circuits as well as reducing the product size, resulting in a reduction of production cost. In addition to a compact antenna structure and integrated design, it is also desired to have an antenna structure combining two antenna structures into one to receive two different signals in order to increase the signals' intensity. If it is realized, the whole circuit's functionality is enhanced and the size of the antenna is greatly reduced, resulting in the production cost reduction and the improvement of industrial usefulness. Therefore, some polarization diversity antenna designs have been described in order to realize these purposes. For example, an integral diversity antenna using two orthogonal planar inverted-F antennas is described in specification number U.S. Pat. No. 5,138,328, entitled "Integral diversity antenna for a laptop computer", and an antenna apparatus using two orthogonal planar inverted-F antennas is described in specification number U.S. Pat. No. 5,420,599. An antenna structure having two orthogonal folded monopole planar antennas is described in specification number U.S. Pat. No. 5,757,333, entitled "Communications antenna structure". The conventional approaches mentioned above can fulfil the purpose of polarization diversity. However, none of them can lead to a complete integration of the antenna and the circuit into a single circuit broad but to add a radiation metal for the integration. In this way, it increases the complexity of manufacturing the circuits due to the low integration degree, as well as the size of the circuits. As a result, the production cost is greatly increased, reducing the competitiveness of the respect products.

Thus, antenna systems capable of completely integrating the antenna with the printed circuit board are described in specification number U.S. Pat. No. 5,828,346, entitled "Card antenna" and specification number U.S. Pat. No. 5,990,838, entitled "Dual orthogonal monopole antenna system", for lowering the complexity of manufacturing circuits. However, they do not mainly concern about downsizing of circuit design and thus the antenna of relative large size is employed. In terms of the trend towards downsizing for circuit design, this large size circuit has no much contribution to the improvement of the products' competitiveness.

SUMMARY OF THE INVENTION

It is therefore an object of the invention to provide an antenna apparatus, integrated with the printed circuit board completely, lowering the complexity of manufacturing circuits and the production cost.

It is another object of the invention to provide a planar antenna structure, which employs a circuit design of downsizing, resulting in a more compact circuit real-estate and more useful in practice as well.

It is still another object of the invention to provide a planar antenna structure, employing the antenna structures to fulfil polarization diversity, resulting in the improvement of the operation performance and the intensity of the received signals. In this way, it improves the characteristic of the entire circuit and enhances the industrial usefilness of the products.

In accordance with the object of the invention, it provides a planar antenna apparatus, which is concisely described as follows.

The planar antenna apparatus includes a monopole antenna. The monopole antenna has a number of slits, where the slits are arranged so that a path through the monopole antenna is formed while the path has sharp turns in alternating directions. In this way, through the arrangement of slits, the excited surface current's path is extended so that the monopole antenna operates at a lower frequency. Therefore, the monopole antenna is a reduced one as compared with the monopole antenna without slits operating at the same frequency. In addition, two ground conductors are mounted on either side of the monopole antenna, where ground conductors are apart from the monopole antenna respectively. As such, there is a coplanar waveguide (CPW) effect among the ground conductors and the monopole antenna, leading to the entire antenna apparatus presenting almost good input-impedance matching. Finally, a coupling device, such as microstrip line or coaxial line, feeds the monopole antenna so as to transmit and receive signals.

The planar antenna apparatus can further be employed, fulilling the purpose of polarization diversity. During implementation, one can adopt two antenna apparatuses mentioned above to be mounted in different directions, such as in perpendicular directions. In the case of the two antenna apparatuses with slits perpendicular to one another, the excited surface currents of the antennas flow in directions perpendicular to each other. As a result, the polarization planes and both E-plane and H-plane patterns of the two antennas are perpendicular to one another. Thus, the purpose of polarization diversity is fulfilled.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 1:
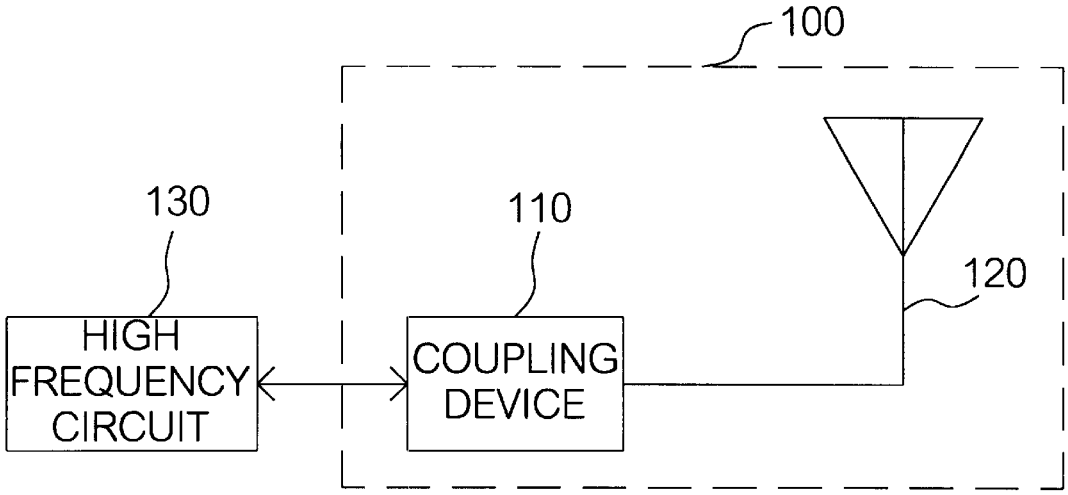
FIG. 1 (PRIOR ART)
FIG. 1 (Prior Art) illustrates the connections between an antenna structure and a high frequency circuit.
Figure 2:
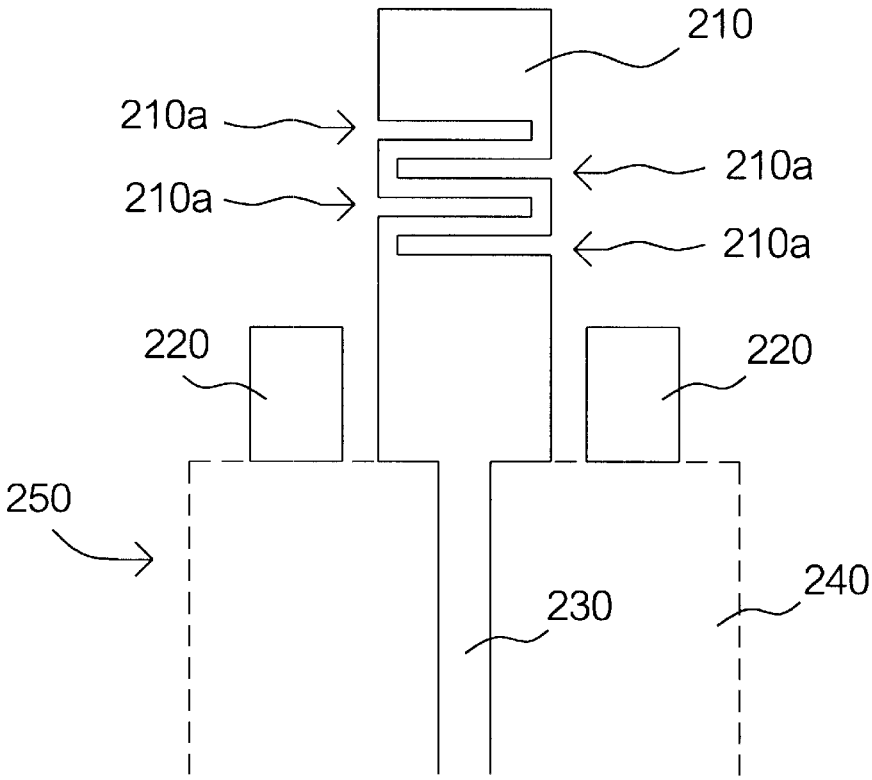
FIG. 2 illustrates a planar antenna apparatus according to a preferred embodiment of the invention.

For an antenna, since its receiving characteristic is the counterpart of the transmission characteristic, the following descriptions will only concern about the antenna operating in the transmission mode. Referring now to FIG. 2, it illustrates a planar antenna apparatus according to a preferred embodiment of the invention. The planar antenna apparatus includes a monopole antenna 210 and coupling device 250. The monopole antenna 210 is a strip of conductor having a number of slits 210*a* formed on the monopole antenna 210, where the slits 210*a* are arranged so that a path through the monopole antenna 210 is formed and the path proceeds by sharp turns in alternating directions. In other words, the slits 210*a* are arranged on the monopole antenna 210 so that one end of each slit forms an opening on one side of the monopole antenna 210 and adjacent slits have the openings towards opposite directions. For implementation, one can refer to FIG. 2 specifically. Since the adjacent slits 210*a* are formed in such an arrangement, when the monopole antenna 210 is excited, an excited surface current flows along the path through the monopole antenna 210, resulting in a path of the excited surface current which is longer than one that the monopole antenna 210 without slits has. The increase in the path of the excited surface current of the monopole antenna 210 implies a decrease of the operating frequency of the monopole antenna 210. In this way, since the excited surface current's path is extended through the arrangement, the size of the monopole antenna 210 does not require to increase greatly for making the monopole antenna 210 operating at a lower frequency. Therefore, the monopole antenna 210 is already an effectively reduced one as compared with a monopole antenna without slits operating at the same frequency.

For a conventional monopole antenna, it is designed to have an operating length of a quarter of an operating wavelength (i.e. $\lambda/4$, where $\lambda$ is the wavelength). In terms of the operating length, since the excited surface current's path is extended, a monopole antenna according to the invention has an operating frequency which is lower than one that the conventional monopole antenna with the same operating length has. If a monopole antenna with more slits 210*a* is designed according to the invention, a much lower operating frequency is obtained for the monopole antenna. On the other hand, if it aims at a certain operating frequency, the operating length of the monopole antenna 210 can be reduced by increasing the number of slits 210*a* or extending the length of the slits for the purpose of compact design. In practice, when the operating frequency is 2.4 GHz, the monopole antenna 210 can be designed to have an operating length of 0.2 times the operating wavelength (i.e. $0.2\lambda$). That is to say, the operating length has reduced by 20% as compared with the operating length of the conventional monopole antenna operating at the identical operating frequency. Thus, the size of the monopole antenna is effectively reduced.

The operating frequency can be reduced by the increase of the number of slits, resulting in a more compact antenna design. However, as the number of slits increases, the input reactance of the input impedance of the monopole antenna 210 increases so that the input impedance presents its inductance. In this way, it leads to the mismatch of the antenna to the feed line, increasing the voltage standing wave ratio (VSWR). In this case, the input energy cannot completely radiate through the antenna, resulting in lowering the performance. Therefore, it is important that how to prevent the input reactance from increasing, making the input impedance matched to the feed line and hence improving the performance of the antenna. In the following description, it is about to discuss the antenna according to the invention with an input impedance of 50 ohms. It should be noted that, through appropriate design according to the invention, one can design an antenna with an input impedance value other than 50 ohms, without departing from the spirit of the invention. In order to resolve the problem of impedance mismatch with a feed line, a coplanar waveguide of specific size is employed in the invention. The coplanar waveguide of specific size indicates that a conductor of a size smaller than the antenna is used as the ground plane, called ground conductor. Two ground conductors 220 are mounted on either side of the monopole antenna 210, where each of the ground conductors 220 and the monopole antenna 210 are spaced out a certain distance apart, as shown in FIG. 2. As such, there is a capacitance coupling effect on the ground conductors 220 and 210. In this way, through appropriate adjustment of the size of ground conductors 220 and the separation of the monopole antenna 210 from either of the ground conductors 220, it leads to an equivalent capacitance suitable to compensate for the inductance of input impedance of the antenna due to the arrangement of slits 210*a* on the monopole antenna 210. In this way, the input impedance of the monopole antenna 210 can be adjusted to present resistance characteristic approximately at the resonant frequency. In practice, due to the use of the compensation effect, when the monopole antenna according to the invention operates at 2.4 GHz, the monopole antenna obtains a bandwidth of more than 17%, in terms of the operating frequency. This bandwidth is wider than one that the conventional monopole antenna has. It should be noted that the coupling device for feeding the monopole antenna 210 can be the microstrip line 230 or a device capable of performing the identical function, such as a coplanar waveguide. In the case of using microstrip line, a ground conductor 240, which is separated from the microstrip line 230 by a dielectric layer, is used as the ground of the microstrip line 230. In addition, in order to match the input impedance of the monopole antenna 210 to the coupling device 250, the characteristic impedance of the coupling device 250 must be 50 ohms as well. Thus, the coupling device including the microstrip line 230 or the coplanar waveguide discussed above must be of 50 ohms.

Figure 3:
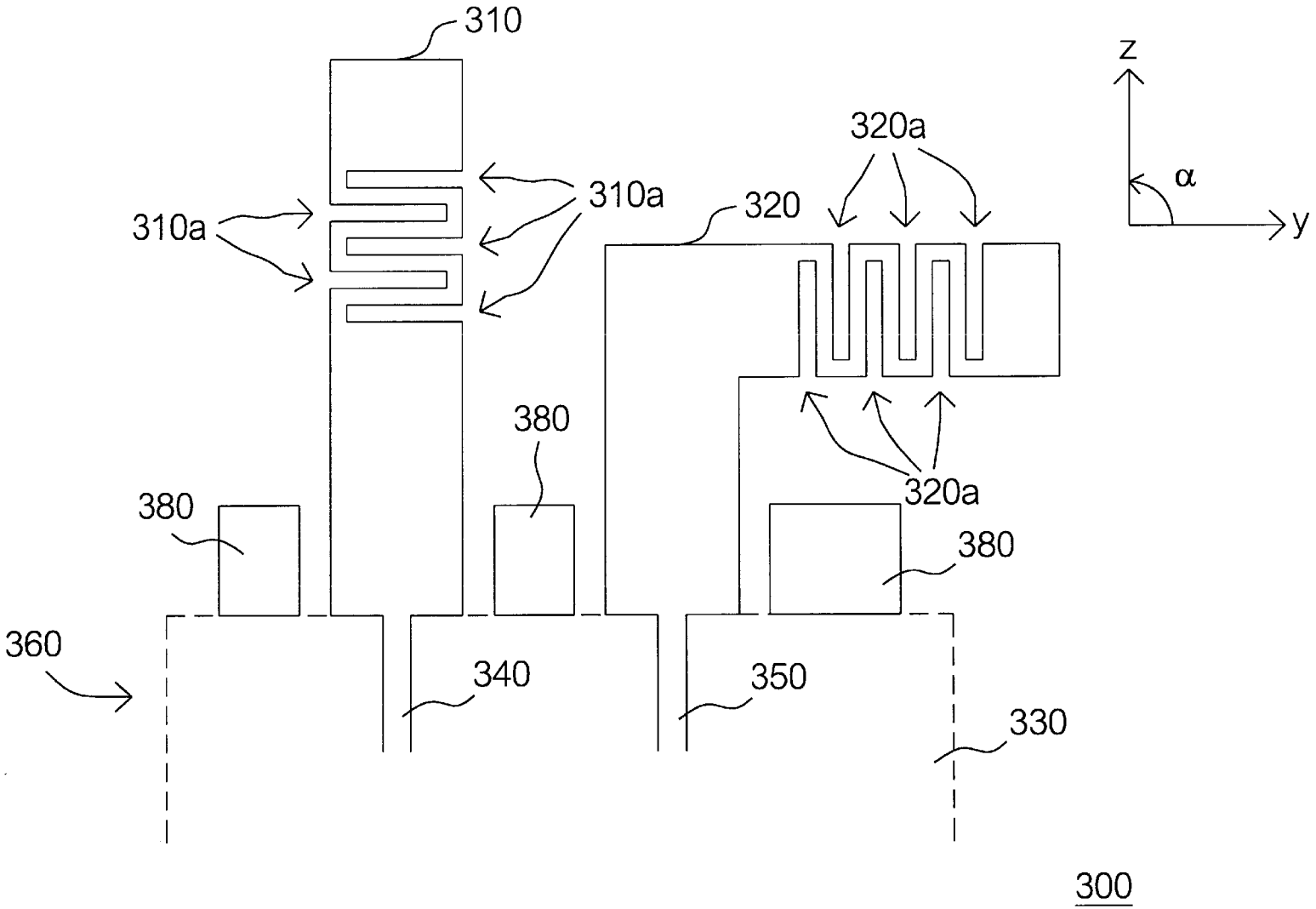
FIG. 3 illustrates another planar antenna apparatus according to the preferred embodiment of the invention.

Referring to FIG. 3, it illustrates another planar antenna apparatus according to the preferred embodiment of the invention. In this example, the monopole antenna 310 and monopole antenna 320 are designed according to the preferred embodiment described above. In other words, both slits according to the invention are employed in the design of the monopole antennas 310 and 320 to reduce the operating frequency, resulting in a compact antenna apparatus. Unlike the antenna apparatus mentioned previously, the example includes two antennas mounted in different directions so that the entire antenna apparatus has the effect of polarization diversity as well as the individual antenna in different degree of compactness. This antenna apparatus shows another object of the invention and is described as follows.

FIG. 3 illustrates a structure of the antenna apparatus includes monopole antennas 310 and 320, where the monopole antenna 310 has a number of slits 310*a* and the monopole antenna 320 has a number of slits 320*a*. Since the purpose, method, principle, and effect of using slits on a monopole antenna in this structure are identical to that described in the embodiment above, it will not be described for the sake of brevity. In addition, the antenna structure includes a number of ground conductors 380. As shown in FIG. 3, the ground conductors 380 are mounted on either side of the monopole antennas 310 and 320 respectively, and each of them is mounted apart from the monopole antennas 310 and 320. In this way, it can lead to appropriate equivalent capacitance, resulting in the input impedance of the antennas in the antenna structure presenting resistance characteristic approximately at the resonant frequency. In FIG. 3, only one ground conductor is mounted between the monopole antennas 310 and 320 as the ground plane. As a result, the total space occupied by the ground conductors is saved, leading to a more compact antenna apparatus.

As can be seen from FIG. 3, the monopole antenna 310 extends towards the z-axis while the monopole antenna 320 extends towards y-axis, so the monopole antenna 310 makes an angle a of 90° with the monopole antenna 320. It should be noted that, according to the invention, any person who has known this art can design that the monopole antenna 310 and monopole antenna 320 extend towards different directions, i.e. the angle may be another values such as $\alpha$=60°, 45°, . . . etc.

On the other hand, the coupling device 360, which is used for feeding in the transmitted or received signal, can be microstrip line or a device which is capable of performing the required function, such as coplanar waveguide. Take the coupling device using microstrip lines as an example. The coupling device includes a microstrip line 340 and microstrip line 350, in which the microstrip line 340 feeds the monopole antenna 310 while the microstrip line 350 feeds the monopole antenna 320. A ground conductor 330, which is separated from the microstrip line 340 and microstrip line 350 by a dielectric layer of a certain thickness, is employed as the common ground ofthe microstrip lines 340 and 350. Besides, in order to match the input impedance of the monopole antennas 310 and 320, each having input impedance of 50 ohms, to the coupling device 360 respectively, the characteristic impedance of the coupling device 360 must be 50 ohms. In this way, the input impedance of each of the components including the microstrip lines 340 and 350, and coplanar waveguide have to be made equal to 50 ohms respectively.

During excitation, since the monopole antenna 310 is perpendicular to the monopole antenna 320, the excited surface currents of the antennas flow in directions perpendicular to each other. As a result, polarization planes and both E-plane and H-plane radiation patterns of the monopole antennas 310 and 320 are orthogonal to each other so that the goal of polarization diversity is accomplished.

In the following description, it is about to illustrate the spirit of the invention more specifically with the help of experimental data. In FIG. 3, the monopole antenna 310 has five slits 310*a*, each of which is 6 mm long and 0.5 mm wide, and the slits 310*a* are spaced out 0.75 mm apart; the monopole antenna 320 has six slits 320*a*, each of which is 6 mm long and 0.5 mm wide, and the slits 320*a* are spaced out 0.75 mm apart. The monopole antennas 310 and 320 make an included angel a of 90°, i.e. they are located perpendicularly to each other. The monopole antenna 310 has excited surface current flowing along the z-axis, resulting in an effective path of 25 mm long; the monopole antenna 320 has excited surface current flowing along the y-axis, resulting in an effective path of 22 mm long. With regard to the coplanar waveguide, a number of ground conductors 380 are adopted, each of which is 12 mm long and 5 mm wide. Finally, the operating frequencies of the two antennas are 2.4 GHz.

Figure 4:
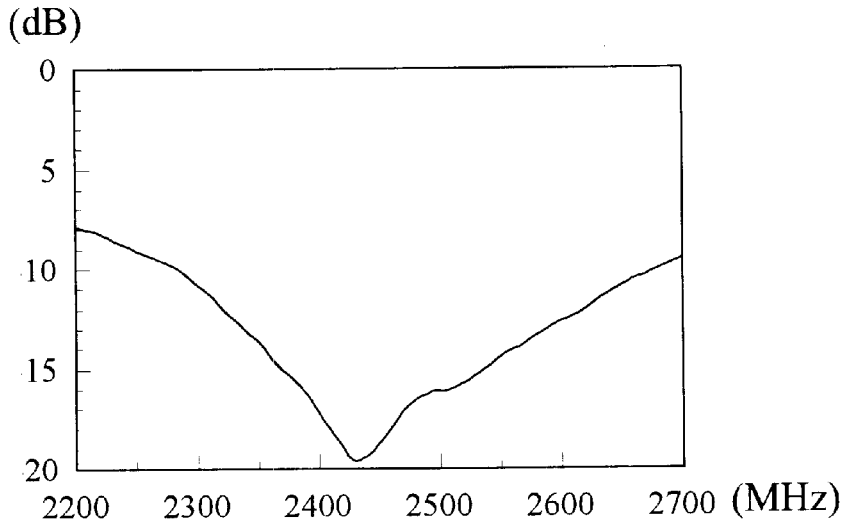
FIG. 4 illustrates the measured return loss for one monopole antenna shown in FIG. 3.

Referring now to FIG. 4, it illustrates the measured return loss for the monopole antenna 310 shown in FIG. 3, in which the x-axis indicates the operating frequency in MHz and the y-axis indicates the return loss in dB. As can be seen from FIG. 4, if the impedance bandwidth is defined in terms of return loss of 10 dB, the monopole antenna 310 can operate within the range between 2274 MHz and 2692 MHz, i.e. the bandwidth is 418 MHz. If it is referenced to the central frequency 2.4 GHz, the bandwidth is 17.4%.

Figure 5:
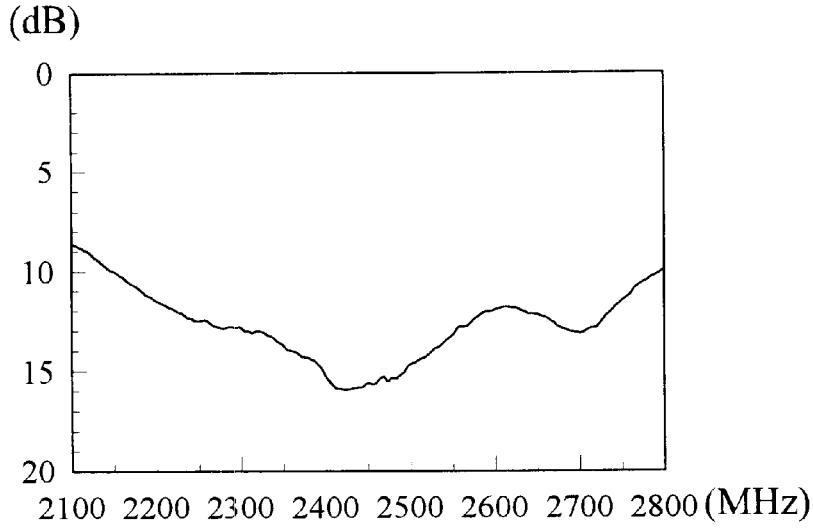
FIG. 5 illustrates the measured return loss for the other monopole antenna shown in FIG. 3.

Referring now to FIG. 5, it illustrates the measured return loss for the monopole antenna 320 shown in FIG. 3, in which the x-axis indicates the operating frequency in MHz and the y-axis indicates the return loss in dB. As can be seen from FIG. 5, if the impedance bandwidth is defined in terms of return loss of 10 dB, the monopole antenna 320 can operate within the range between 2151 MHz and 2796 MHz, i.e. the bandwidth is 645 MHz. If it is referenced to the central frequency 2.4 GHz, the bandwidth is 26.8%.

As can be seen from the results presented by FIGS. 4 and 5, through the compensation effect of coplanar waveguide, the operating bandwidth of the antenna with different number of slits presents different results.

Figure 6A:
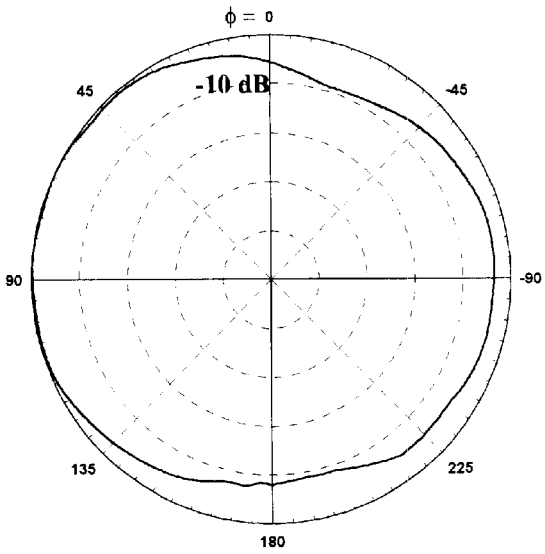
FIG. 6A is chart illustrating the measured far-field pattern of the H-plane (x-y plane) for one monopole antenna in FIG. 3.
Figure 6B:
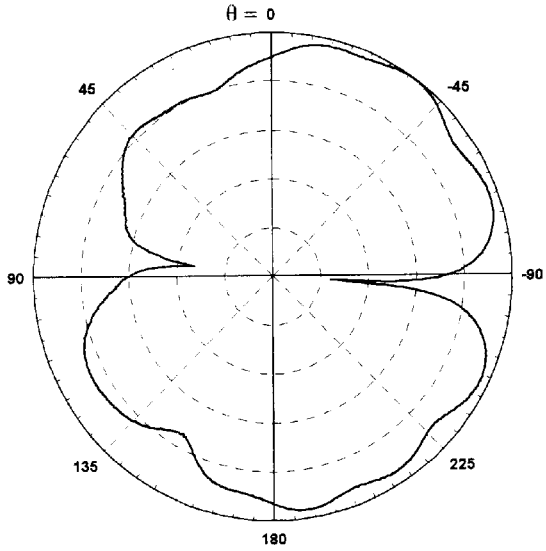
FIG. 6B is chart illustrating the measured far-field pattern of the E-plane (x-z plane) for one monopole antenna in FIG. 3.
Figure 7A:
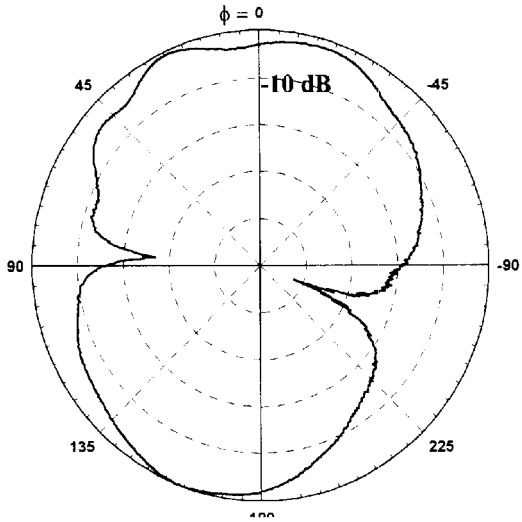
FIG. 7A is chart illustrating the measured far-field pattern of the E-plane (x-y plane) for the other monopole antenna in FIG. 3.
Figure 7B:
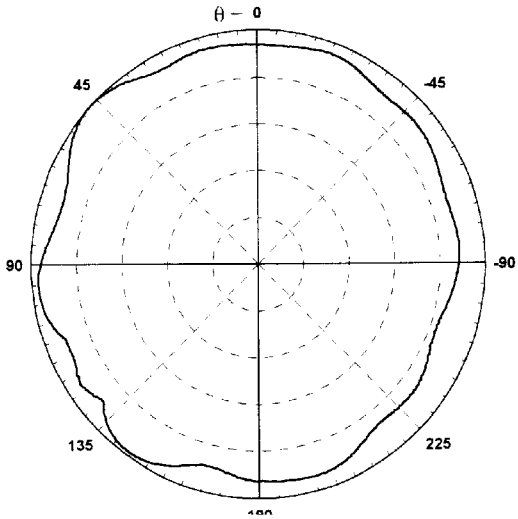
FIG. 7B is chart illustrating the measured far-field pattern of the H-plane (x-z plane) for the other monopole antenna in FIG. 3.

Referring now to FIGS. 6A and 6B, they illustrate the far-field patterns measured for the monopole antenna 310. FIG. 6A is the chart of the H-plane of the monopole antenna 310, i.e. the far-field pattern in the x-y plane. It can be apparant that the chart in FIG. 6A is identical to the omni-directional pattern of conventional monopole antenna in H-plane approximately. FIG. 6B is the chart of the E-plane of the monopole antenna 310, i.e. the far-field pattern in the x-z plane, and the field pattern is approximately identical to the field pattern of conventional monopole antenna in E-plane, in which there are two regions on the z-axis being about equal to electric field density of null. Referring now to FIGS. 7A and 7B, they illustrate the far-field patterns measured for the monopole antenna 320. FIG. 7A is the chart of the E-plane of the monopole antenna 320, i.e. the far-field pattern in the x-y plane. FIG. 7B is the chart of the H-plane of the monopole antenna 320, i.e. the far-field pattern in the x-z plane. As can be seen from the Figures, the field pattern of the monopole antenna 320 is also identical to the field pattern of conventional monopole antenna approximately.

Further, as compared FIG. 6A with FIG. 7A, and FIG. 6B with FIG. 7B, the feature of the example according to the invention is to be more apparent. Since the monopole antennas 310 and 320 are perpendicular to one another, the excited surface currents of the monopole antennas 310 and 320 flow in directions perpendicular to each other. As a result, the polarization planes and both E-plane and H-plane patterns are perpendicular to one another. To be more specific, if the x-y plane is taken as the reference plane, it is both the H-plane of the monopole antenna 310 and the E-plane of the monopole antenna 320; in addition, if the x-z plane is taken as the reference plane, it is both the E-plane of the monopole antenna 310 and the H-plane of the monopole antenna 320. In this way, since a reference plane can be two different field patterns of antennas, the object of providing polarization diversity is achieved.

It should be noted that the design parameters presented above, such as the impedance values and the size of the slits, are only taken for example, and they are not used to define the limitations of the invention. According to the invention, any person who has known this art can adjust these design parameters to the design achieving the similar functionality without departing from the spirit of the invention.

As disclosed in the embodiment according to the invention above, the planar antenna apparatus includes the following advantages.

1. Complete integration with the circuit board. Due to the fabrication of the planar antenna apparatus being capable of integrating into the circuit board completely, the production cost and the complexity of the fabrication are reduced, increasing the production competitiveness.

2. Miniaturization design. The antenna size is effectively reduced by using the miniaturization design, making it more useful in practice.

3. Fulfillment of polarization diversity. According to the invention, an antenna apparatus can fulfil polarization diversity, improving the performance of the antenna apparatus and increasing the intensity of the received signals to improve the characteristic of the entire circuit. As a result, the industrial usefulness of the entire circuit is increased.

The invention can be applied to a variety of communication applications including personal mobile communication devices and systems compliant to different standards, such as global system for mobile communications (GSM) 900/1800, digital communication system (DCS) 1800/1900, digital enhanced cordless telephone (DECT) 1800, and personal communication system (PCS) 1900, 2.45 GHz domestic communication products, wireless local area network (LAN) products, and wireless communication transmitting and/or receiving modules.

In addition, the antenna structure according to the invention is compliant to the application specification for wireless LAN, and the antenna structure can be completely integrated into the personal computer memory card international association (PCMCIA, or PC) card, which is mainly used in notebook personal computers or mobile computing devices. In terms of industrial usefulness, the invention presents its great business potential.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A planar antenna apparatus, comprising:

a monopole antenna having a plurality of slits, the slits being arranged so that a path through the monopole antenna is formed, the path having sharp turns in alternating directions;

a plurality of conductors, each conductor being connected to ground, the conductors being disposed on either side of the monopole antenna and being apart from the monopole antenna to form capacitive loads; and a coupling device, connected to the monopole antenna, for signal transmission.

2. A planar antenna apparatus according to claim 1, wherein an impedance of the coupling device is approximately 50 ohms.

3. A planar antenna apparatus according to claim 1, wherein the coupling device is a microstrip line.

4. A planar antenna apparatus according to claim 3, wherein an impedance of the microstrip line is approximately 50 ohms.

5. A planar antenna apparatus according to claim 1, wherein the coupling device is a coplanar waveguide.

6. A planar antenna apparatus according to claim 5, wherein an impedance of the coplanar waveguide is approximately 50 ohms.

7. A planar antenna apparatus, comprising:

a monopole antenna having a plurality of slits, the slits being arranged so that a path through the monopole antenna is formed, the path having sharp turns in alternating directions;

a plurality of conductors, each conductor being connected to ground, the conductors being disposed on either side of the monopole antenna and being apart from the monopole antenna to form capacitive loads; and a microstrip line, connected to the monopole antenna, for signal transmission.

8. A planar antenna apparatus according to claim 7, wherein an impedance of the microstrip line is approximately 50 ohms.

9. A planar antenna apparatus, comprising:

a first monopole antenna having a plurality of first slits, the first slits being arranged so that a path through the first monopole antenna is formed, the path having sharp turns in alternating directions;

a second monopole antenna having a plurality of second slits, the second slits being arranged so that a path through the second monopole antenna is formed, the path having sharp turns in alternating directions, wherein the second monopole antenna makes an angle with the first monopole antenna;

a coupling device, providing separate connections to the first and second monopole antennas, for signal transmission; and a plurality of conductors, each conductor being connected to ground, the conductors being disposed on either side of the first monopole antenna and the second monopole antenna respectively, and being apart from the first and second monopole antennas to form capacitive loads.

10. A planar antenna apparatus according to claim 9, wherein the angle is of 90 degrees.

11. A planar antenna apparatus according to claim 9, wherein an impedance of the coupling device is approximately 50 ohms.

12. A planar antenna apparatus according to claim 9, wherein the coupling device is a microstrip coupling device.

13. A planar antenna apparatus according to claim 12, wherein an impedance of the microstrip coupling device is approximately 50 ohms.

14. A planar antenna apparatus according to claim 12, wherein the microstrip coupling device comprises:

a first microstrip line coupled to the first monopole antenna; and a second microstrip line coupled to the second monopole antenna.

15. A planar antenna apparatus according to claim 14, wherein an impedance of the first microstrip line is approximately 50 ohms.

16. A planar antenna apparatus according to claim 14, wherein an impedance of the second microstrip line is approximately 50 ohms.

17. A planar antenna apparatus according to claim 9, wherein the coupling device is a coplanar waveguide.

18. A planar antenna apparatus according to claim 17, wherein an impedance of the coplanar waveguide is approximately 50 ohms.

* * * * *